US005184476A

United States Patent [19]

Desrosiers et al.

[11] Patent Number: 5,184,476

[45] Date of Patent: Feb. 9, 1993

[54] COUNTER-HEIGHT WATER DISPENSER

[75] Inventors: André Desrosiers; Gary Savage, both of Montreal, Canada

[73] Assignee: Addico Products Inc., Quebec, Canada

[21] Appl. No.: 746,613

[22] Filed: Aug. 19, 1991

[51] Int. Cl.[5] ..... B67D 5/62

[52] U.S. Cl. ..... 62/389; 62/394; 62/395

[58] Field of Search ..... 62/389, 390, 391, 395; 222/146.6

[56] References Cited

U.S. PATENT DOCUMENTS

| | | | |
|---|---|---|---|
| 2,909,044 | 10/1959 | Wilcox | 62/389 |
| 2,920,463 | 1/1960 | Gould | 62/394 X |
| 3,035,418 | 5/1962 | Wright | 62/389 X |
| 3,225,559 | 12/1965 | Fischer | 62/395 X |
| 3,232,489 | 2/1966 | Buffington | 62/389 X |
| 3,263,442 | 8/1966 | Timmersman | 62/394 |
| 3,269,143 | 8/1966 | Gasparovich | 62/389 |
| 3,824,801 | 7/1974 | Laudato et al. | 62/395 X |
| 3,943,727 | 3/1976 | Wade | 62/395 |
| 4,597,509 | 7/1986 | Pereira | 62/394 X |
| 4,779,426 | 10/1988 | Desrosiers | 62/390 |

*Primary Examiner*—Henry A. Bennet

*Assistant Examiner*—Christopher Kilner

[57] ABSTRACT

A counter-height water dispenser which is comprised of a housing having a top wall disposed at substantially counter height. A water reservoir is supported in a top part of the housing. The reservoir has an open-top end section and a bottom cooling well section. The top wall is formed as a cover which is removably secured over an open area of the housing for access to an opening in the open-top end section of the reservoir. A compressor and condensor coil is mounted below the reservoir with a cooling coil being associated therewith. The cooling coil is disposed about the well section of the reservoir. An outlet port is provided in the well section and is connected to a low-pressure electric pump. The pump has an outlet tube connected to a dispensing faucet which is removably secured on the top wall of the housing adjacent the open area. The faucet has a low-pressure sealing coupling in its connection with the outlet tube. A drip tray is positioned in front of the faucet and a switch actuates the pump to dispense water from the reservoir through the faucet at low pressure so that water in the faucet will flow back in the outlet tube and reservoir when the pump is deactuated whereby the low pressure joints are not subject to pressure when water is not dispensed.

10 Claims, 2 Drawing Sheets 39
80
79
10
64
68
50
35
36
54
38
30
25
55
45
24
74
33
56
40
34
41
24'
32'
26
27
71
37
32
28
12
21
31
17
23
14
22'
29
22
19
13
18
15
20
22'
12
11
16
34

COUNTER-HEIGHT WATER DISPENSER

BACKGROUND OF INVENTION

1. Field of the Invention

The present invention relates to a counter-height water dispenser having a removably connectable faucet and low-pressure joints whereby water is dispensed at low-pressure.

2. Description of Prior Art

The present invention is an improvement over water cooler dispensing devices such as my U.S. Pat. No. 4,779,426 which issued on Oct. 25, 1988 or U.S. Pat. No. 4,629,096 issued on Dec. 16, 1986. Both these patents show a water dispensing housing wherein a water bottle is positioned on top of the housing to feed water under gravitational pressure to dispensing spouts which connect to a cooling reservoir provided in the housing. There are various inconveniences in using such liquid dispensers and one of these is that each time a person wishes to dispense water into a drinking cup, it is necessary for that person to bend down to position the cup under the faucets. Another major inconvenience with the use of these dispensers is that a large and heavy water bottle must be placed in an inverted position on top of the housing with the dispensing spout of the water bottle being opened and guided in a seat above a reservoir. These water bottles usually contain from between 15 to 20 litres of water making them relatively heavy and cumbersome to handle, particularly when it is necessary to orient the bottleneck towards an open area in the top of the housing. One must also quickly incline the bottle while lifting it to sit on the opening in the top of the housing. Often, these bottles are dropped and cause injury to the user or water is spilled.

Another inconvenience is that the dispensing valve may break or stay open causing all of the water in the reservoir to spill on the floor adjacent the dispenser housing. Further, because the water bottle is positioned on top of the housing, the entire unit is fairly large making it awkward to handle and often resulting in an eyesore.

SUMMARY OF INVENTION

It is a feature of the present invention to overcome all of the above-mentioned disadvantages of the water dispensers of the type above-described.

According to a broad aspect of the present invention, there is provided a counter-height water dispenser which comprises a housing having a top wall disposed at substantially counter-height. A water reservoir is supported in a top part of the housing. The reservoir has an open-top end section and a bottom cooling well section. The top wall is formed as a cover removably secured over an open area of the housing for access to an opening in the top end section of the reservoir. A compressor and condensor coil is mounted below the reservoir and a cooling coil associated therewith is disposed about the well section of the reservoir. Insulation means is associated with the cooling coil. An outlet port is provided in the well section and is connected to a low-pressure electric pump. The pump has an outlet tube connected to a dispensing faucet removably secured on the top wall of the housing adjacent the open area. The faucet has a low-pressure sealing coupling in its connection with the outlet tube. The cover has a drip tray in a top surface thereof. A switch is associated with the top wall for actuating the pump to dispense water from the reservoir through the faucet at low-pressure so that water in the faucet will flow back in the outlet tube and reservoir when the pump is de-actuated whereby low-pressure joints are not subject to pressure when water is not dispensed.

BRIEF DESCRIPTION OF DRAWINGS

A preferred embodiment of the present invention will now be described with reference to the accompanying drawings in which.

DESCRIPTION OF PREFERRED EMBODIMENTS

Figure 1:
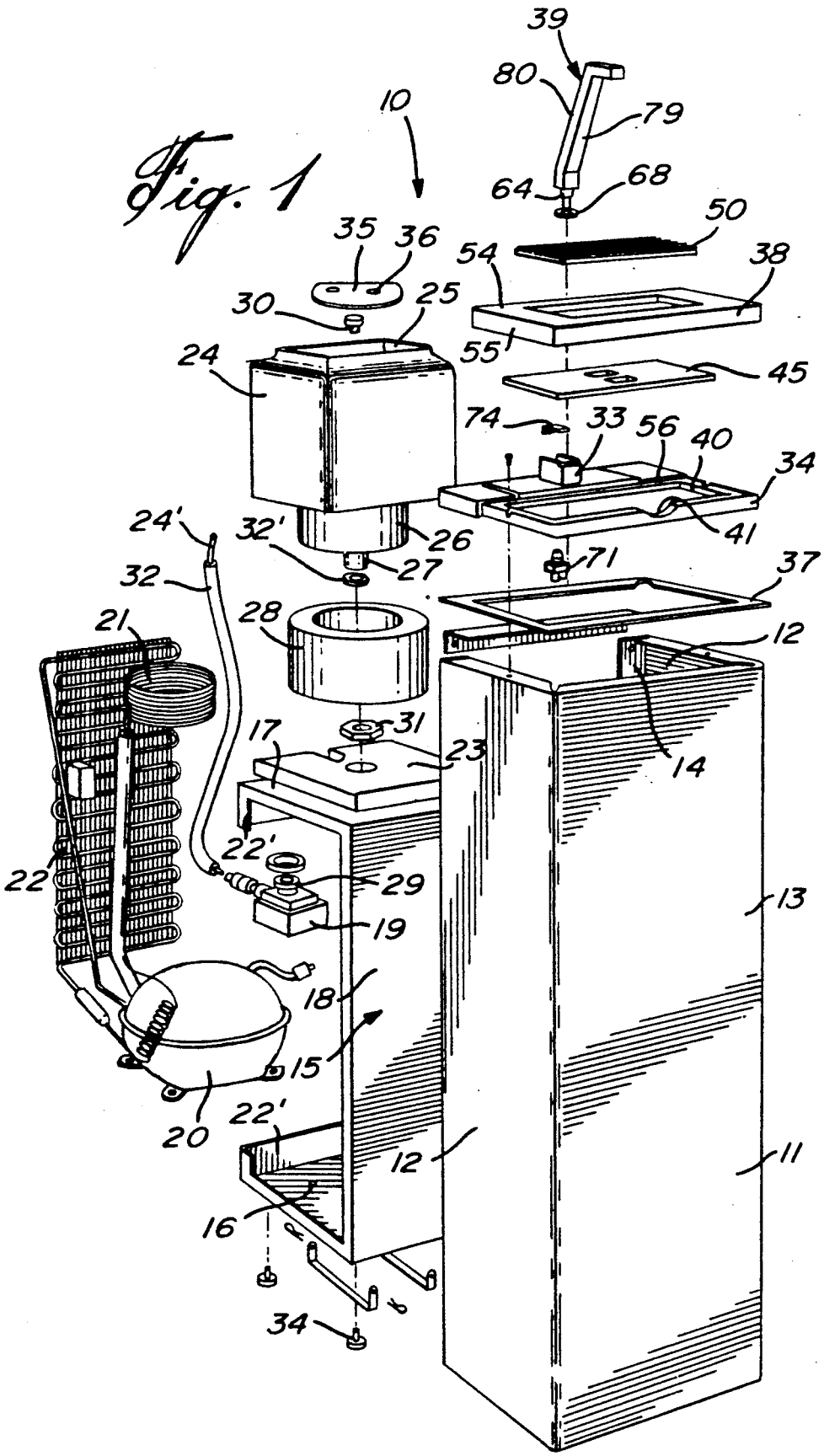
FIG. 1 is an exploded view of the counter-height water dispenser of the present invention.

Referring now to the drawings, and more particularly to FIG. 1, there is shown generally at 10, the counter-height water dispenser of the present invention. The dispenser is comprised of an elongated rectangular housing 11 having side walls 12, a front wall 13, and an open-ended rear wall 14 and a base (not shown). A support frame 15 is removably secured in the housing. The frame has a bottom wall 16, a top wall 17, and an interconnecting rear wall 18.

A low-pressure water pump 19 is secured under the top wall 17 of the support frame. A compressor 20 is secured to the bottom wall 16 of the frame and has its serpentine shape condensor coil 22 secured across end flanges 22' which extends from the top and bottom walls of the support frame to provide proper ventilation of the condensor coils.

A cooling coil 21 is also connected to the compressor and disposed on top of the top wall 17 of the support frame 15 over a foam insulating sheet 23.

A water reservoir 24 is supported over the top wall. The reservoir 24 has an open-top end section 25 through which water can be admitted to fill the reservoir when needed. The reservoir is also formed with a bottom cooling well section 26 herein having a cylindrical shape, and an outlet port 27 is provided at the bottom of the well 26. The cooling coil 21 is positioned about the well section 26 of the container 24 with an insulating foam ring 28 being positioned about the cooling coil 21. The ring 28 and the foam plate 23 insulates the cooling coil from ambient air and maintains the water in the well section cool. A sealing washer 32' and a bolt 30 having an outlet port therein provides a sealing connection between the reservoir and the water pump 19 so that water can flow from the reservoir to the pump. The insulating ring 28 is also dimensioned to support the reservoir 24 on the top wall 17 of the support frame 15 so that the adaptors are not subjected to loading. The pump 19 is secured under the top wall by a bracket not shown.

The pump 19 is provided with a flexible outlet tube 24' which is constructed of low-pressure P.V.C. and covered by an insulating jacket 32 whereby to connect to a low-pressure sealing coupling 33 provided on a removable cover 34 which constitutes the top wall of the housing 11. The support frame 15 is secured within the housing by suitable fasteners (not shown) and the housing is supported on adjustable support legs 16'. A baffle plate 35 is also removably securable in the reservoir 24 over the well section 26 whereby to provide an insulation between the water in the reservoir and that in the well so that the water in the well is maintained substantially cooler than the water in the reservoir. Holes 36 are provided in the baffle plate for access of water to the well and provides a means to remove said baffle by the fingertips. A top sealing gasket 37 provides for a seal between the cover 34 and the housing 11.

Figure 2:
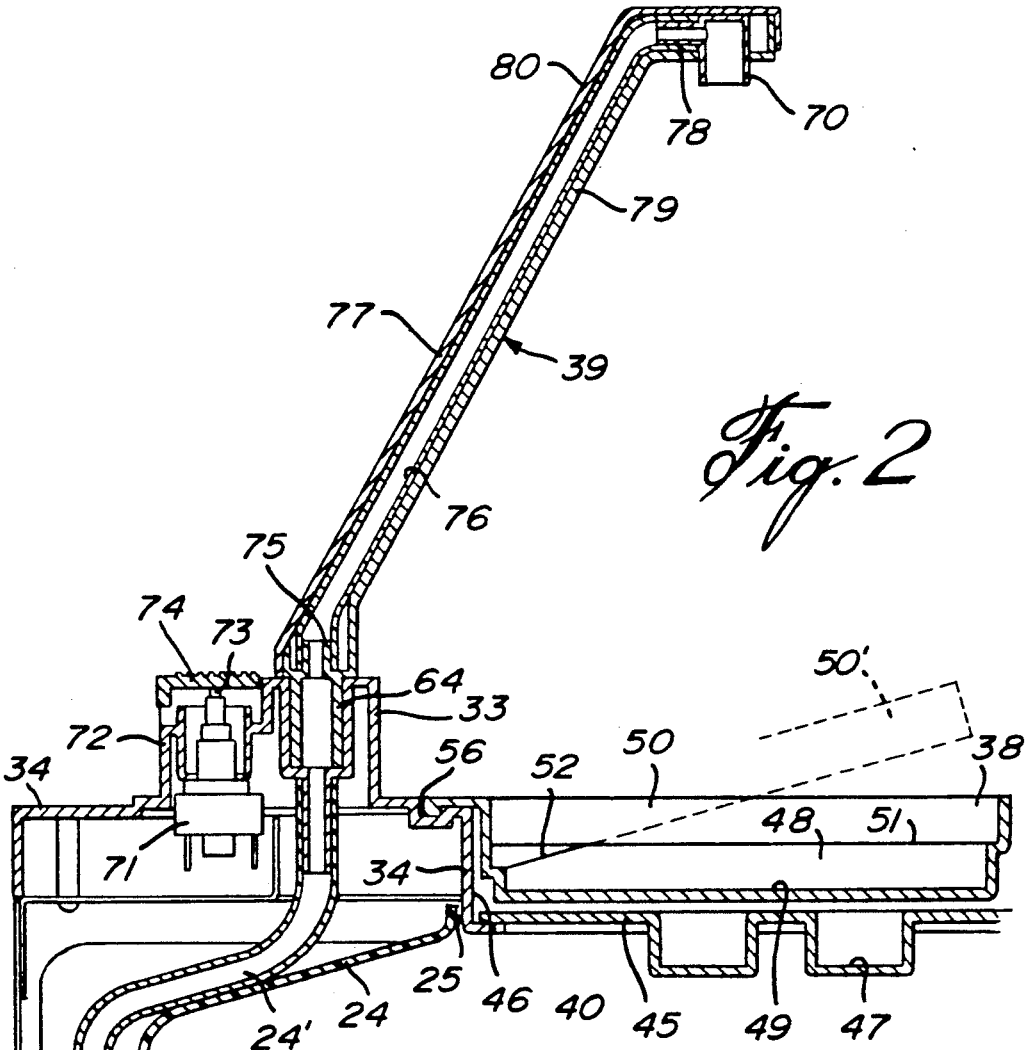
FIG. 2 is a section view showing the lid construction of the cover forming the top wall of the dispenser housing together with the faucet and drip tray.
Figure 3:
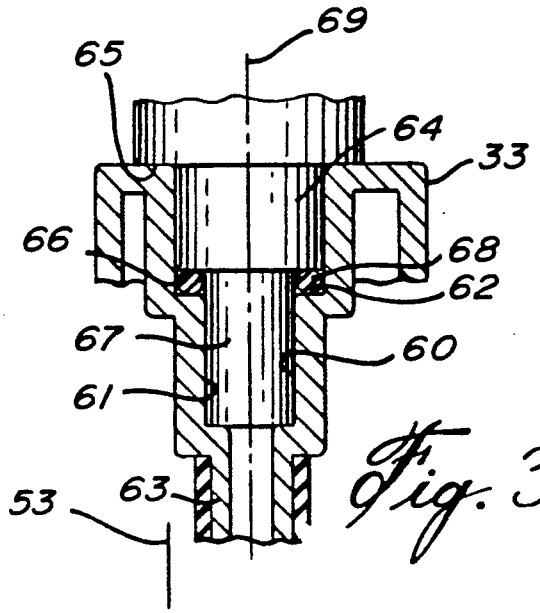
FIG. 3 is an enlarged view showing the construction of the low-pressure sealing coupling of the faucet.

Referring now to FIGS. 2 and 3, there will be described the construction of the cover 34 and the drip tray 38 as well as the construction of the faucet 39.

As shown in FIG. 2, the support frame 15 and the reservoir are dimensioned such that the open-top end section 25 of the reservoir 24 is located a predetermined distance with respect to the cover 34 so as to align with the opening 40 therein to permit water to be inserted into the reservoir. As shown in FIG. 1, the cover has an arcuate recess 41 in a front edge section thereof to guide and support a large water bottleneck when filling the reservoir with water. This helps in supporting the weight of the large water bottle and also guides the bottleneck over the open end of the reservoir.

As also shown in FIG. 2, the drip tray 38 is removably secured to the cover and sits over the opening 40. A lid 45 is positioned over the opening 40 and rests on a circumferential edge 46 formed in the cover about the opening 40. The lid 45 is provided with finger gripping depressions 47 to facilitate the removal of the cover when it is necessary to access the open-end of the reservoir.

The drip tray is provided with opposed elevated support ridges 48 protruding from the bottom wall 49 thereof to support a grill member 50 thereover. The grill terminates flush with the opening of the drip tray. As can be seen, the support ridges have a flat upper surface 51 and a downwardly inclined end section 52 whereby to permit the grill member 50 to be pivoted and removed by the application of finger pressure at a top end edge of the grill so that the grill will be inclined or hinged outwardly, as shown in phantom lines at 50' to permit access thereto when it is necessary to empty the drip tray. The grill is formed as a frame with a plurality of transverse spaced-apart ribs extending thereacross so that water dripping from the faucet will flow between the ribs and into the tray. The drip tray also has a flat circumferential wall and edges 54 and 55 to overlap the section of the cover 34 having the opening 40 to prevent spilled water to flow back into the reservoir or the opening 40 of the cover. A channel 56 also extends transversely across the cover between the faucet base and the drip tray to trap and evacuate spilled water in that region. As shown in FIG. 2, the drip tray is suspended over the cover opening 40 and spaced slightly above the lid 45.

As shown in FIG. 3, the low pressure sealing coupling 33 is molded integrally with the cover, herein from a plastics material, and defines a coupling cavity 60 provided with a recessed lower section 61 to define an inner circumferential shoulder 62. An open-ended tubular coupling 63 extends below the cavity for frictional connection to the pump outlet tube 24'. The faucet is also provided with a bottom pipe section 64 which protrudes from the base 65 of the faucet. An arresting shoulder 66 is defined by a reduced pipe section 67 and an 0-ring seal 68 is positioned about the reduced section 67. The seal is in friction sealing fit between the circumferential shoulder of the cavity and the arresting shoulder when the pipe section 64 is press-fitted into the coupling cavity 61, with the pipe section axially rotatable therein to permit the faucet 39 to be displaced on the rotational axis 69 of the coupling 33. Accordingly, the dispensing head 70 of the faucet can be swung out of alignment with the drip tray when it is necessary to have access to the container opening. Alternatively, the entire faucet can be removed by simply pulling it out of the sealing coupling 33. This is possible as the low-pressure water pump 19 only provides low-pressure in the faucet conduit when it is actuated. When the pump is deactuated, the water in the faucet conduit will flow back into the tube 24' by gravity to a level equal to the level in the container which is below the coupling 33. Accordingly, there is no water under pressure in the sealing coupling 33 when the pump is deactivated and the faucet can be pulled out. This also facilitates cleaning and disinfecting.

In order to actuate the low-pressure water pump 19, there is provided a switch 71 which is mounted in a switch housing 72 also formed integral with the cover 34 and located behind the coupling 33. The switch has a spring loaded actuating finger 73 which extends upwardly and a switch cap 74 is press-fitted on this finger to provide connection thereto. By depressing the switch cap 74, the switch is actuated and power is connected to the low-pressure pump 19 to pump water to the dispensing head 70 of the faucet 39. As shown in FIG. 2, the bottom pipe section 64 of the faucet is also provided with an inner nipple section 75 and a low-pressure flexible conduit 76 is disposed within the faucet housing 77 and is in friction fit at its lower end with the nipple 75. At its upper end, it is in friction fit with a further nipple 78 of the dispensing head 70. The faucet is easily dismantlable and is formed by two snap-fit plastic parts 79 and 80.

It can thus be seen that with the water dispenser, there is provided a means to dispense water at counter-height so that a person does not have to bend down to have access to bottled water. A novel feature of the present dispenser is that it utilizes a low-pressure pump, such as those utilized in aquariums, so that low-pressure joints, couplings and flexible tubes can be used to dispense the bottled water. Also, the novel disposition of parts in the top cover of the housing permits the faucet to be easily connected and disconnected whenever the pump is not operating. It permits the faucet to swivel about its connecting base and it also permits easy removal of the drip tube and easy access to the container while substantially sealing the container open-end from drip water or any other foreign substance that may happen to fall on the top cover of the housing. The drip tray also provides support for cups or containers to be filled with water from the faucet. The housing construction is also easy to assemble and repair.

It is within the ambit of the present invention to cover any obvious modifications of the preferred embodiment described herein, provided such modifications fall within the scope of the appended claims.

We claim:

1. A counter-height water dispenser comprising a housing having a top wall disposed at substantially counter-height, a water reservoir supported in a top part of said housing, said reservoir having an open-top end section and a bottom cooling well section, said top wall being formed as a cover removably secured over an open area of said housing for access to an opening in said open-top end section of said reservoir, a compressor and condensor coil mounted below said reservoir, a cooling coil associated with said compressor and condensor coil, said cooling coil being disposed about said well section of said reservoir, insulation means associated with said cooling coil, an outlet port in said well section, and being connected to a low-pressure electric pump, said pump having an outlet tube connected to a dispensing faucet removably secured on said top wall of said housing adjacent said open area, said faucet having a low-pressure sealing coupling in its connection with said outlet tube, said cover having a drip tray in a top surface thereof, a switch associated with said top wall for actuating said pump to dispense water from said reservoir through said faucet at low pressure so that water in said faucet will flow back in said outlet tube and reservoir when said pump is deactuated whereby said low-pressure joints are not subject to pressure when water is not dispensed.

2. A water dispenser as claimed in claim 1 wherein said low-pressure sealing coupling has a coupling cavity with an inner circumferential shoulder, an open-ended tubular coupling extending below said cavity for frictional connection to said pump outlet tube, said faucet having a bottom pipe section protruding from a base thereof, an arresting shoulder and an O-ring seal about said bottom pipe section, said seal being in friction sealing fit between said circumferential shoulder of said cavity and said arresting shoulder when said pipe section is press-fitted in said coupling cavity with said pipe section axially rotatable therein to permit said faucet to be displaced on said coupling.

3. A water dispenser as claimed in claim 2 wherein said coupling cavity and tubular coupling are integrally molded with said cover, said cover having an arcuate recess formed in a front edge section thereon to guide and support a large water bottleneck when filling said reservoir with water.

4. A water dispenser as claimed in claim 2 wherein said cover has a drip tray removably secured thereto, a low-pressure flexible conduit extending in said faucet and in friction fit at one end with a nipple connection and with a dispensing nozzle at its other end.

5. A water dispenser as claimed in claim 4 wherein said drip tray extends into said opening of said cover for permitting access to said open-top end section of said reservoir, and a lid positioned over said opening, said drip tray having a flat circumferential wall and edges to prevent spilled water to flow back in said reservoir, and a channel extending transversely across said cover between said faucet and said drip tray to trap and evacuate spilled water.

6. A water dispenser as claimed in claim 2 wherein a baffle is removably secured over said bottom cooling well to assist in maintaining the cooler temperature water in said well section, said baffle having perforations therein.

7. A water dispenser as claimed in claim 2 wherein a support frame is removably secured in said housing, said frame having a bottom wall, an upper wall and an interconnecting rear wall, said pump being mounted under said upper wall, said outlet port of said reservoir well being connected to said pump by a removable coupling, said reservoir being supported on said upper wall of said support frame.

8. A water dispenser as claimed in claim 7 wherein said insulation means is a foam ring disposed about said cooling coil, and a foam sheet disposed over said upper wall of said support frame under said coil positioned thereabove.

9. A water dispenser as claimed in claim 3 wherein said switch is secured in a switch housing integrally molded behind said coupling cavity, said switch having a spring-loaded actuating finger extending upwardly behind said faucet, and a switch cap in friction fit connection with said finger.

10. A water dispenser as claimed in claim 2 wherein said bottom pipe section of said faucet is also provided with an inner nipple section, said drip tray having opposed elevated support ridges protruding from a bottom wall thereof to support a grill member flush in a top portion of said drip tray, said support ridges having a planar upper surface and downwardly inclined end sections to permit said grill member to be pivoted and removed by the application of finger pressure on the top end edge of said grill which is aligned with said inclined end sections of said support ridges to cause said grill to incline partly out of said tray for access thereto.

* * * * *